US008061676B1

(12) United States Patent
Kumar

(10) Patent No.: US 8,061,676 B1
(45) Date of Patent: Nov. 22, 2011

(54) FURNITURE HALTING SYSTEM

(76) Inventor: Sivathanu B. Kumar, Tampa, FL (US)

( * ) Notice: Subject to any disclaimer, the term of this patent is extended or adjusted under 35 U.S.C. 154(b) by 233 days.

(21) Appl. No.: 12/455,379

(22) Filed: Jun. 1, 2009

Related U.S. Application Data

(60) Provisional application No. 61/199,488, filed on Nov. 17, 2008.

(51) Int. Cl.
*A47B 97/00* (2006.01)

(52) U.S. Cl. ..... 248/501; 248/500; 248/346.1

(58) Field of Classification Search ..... 248/501, 248/500, 345.1, 351, 354.1, 188.6
See application file for complete search history.

(56) References Cited

U.S. PATENT DOCUMENTS

| | | | | | |
|---|---|---|---|---|---|
| 1,798,901 | A * | 3/1931 | Punt | 248/345.1 |
| 2,281,684 | A * | 5/1942 | Fijux | 248/345.1 |
| 2,331,060 | A * | 10/1943 | Turner | 248/500 |
| 2,683,328 | A * | 7/1954 | Thulin | 248/345.1 |
| 2,769,275 | A * | 11/1956 | Lindgren | 248/345.1 |
| 3,137,090 | A * | 6/1964 | Stouth | 248/345.1 |
| 3,858,838 | A * | 1/1975 | Woodhouse | 248/345.1 |
| 5,799,921 | A * | 9/1998 | Stattel | 248/501 |
| 2006/0097123 | A1 * | 5/2006 | Gallien | 248/500 |

* cited by examiner

*Primary Examiner* — Amy J Sterling

(57) ABSTRACT

A chair member is in a generally planar configuration in a horizontal plane. The chair member has a distal end with a receptive section or linear edge for being contacted by a lower extent of a chair leg. A wall member has a vertical section positionable in contact with an adjacent wall. Each wall member has a horizontal section extending away from the adjacent wall and facing the chair member. An extension assembly has a distal end coupled to the chair member. The extension assembly has a proximal end coupled to the wall member.

5 Claims, 17 Drawing Sheets

FIG 12
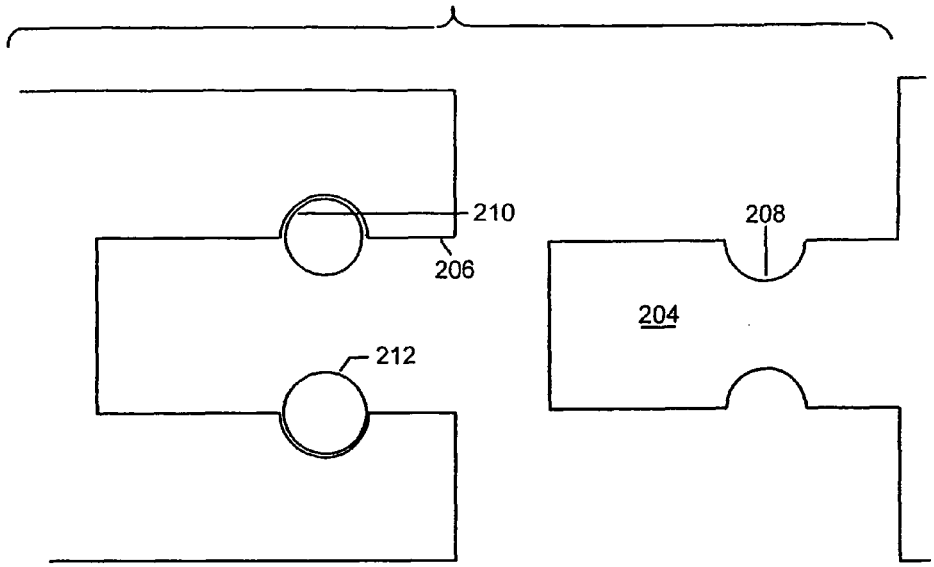
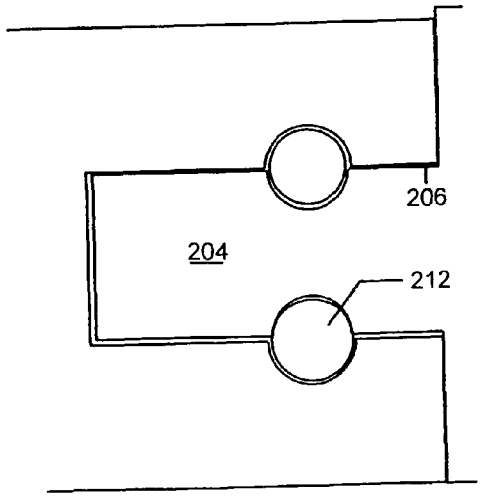
FIG 13

FURNITURE HALTING SYSTEM

RELATED APPLICATION

The present non-provisional patent application is based upon pending Provisional Application No. 61/199,488 filed Nov. 17, 2008, the subject matter of which is incorporated herein by reference.

BACKGROUND OF THE INVENTION

Field of the Invention

The present invention relates to a furniture halting system and more particularly pertains to positioning a chair at a location spaced from an adjacent wall to preclude contacting and damaging the adjacent wall, the positioning being accomplished in a safe, convenient and economical manner.

SUMMARY OF THE INVENTION

In view of the disadvantages inherent in the known types of wall protection systems of known designs and configurations now present in the prior art, the present invention provides an improved furniture halting system. As such, the general purpose of the present invention, which will be described subsequently in greater detail, is to provide a new and improved furniture halting system and method which has all the advantages of the prior art and none of the disadvantages.

To attain this, the present invention essentially comprises a furniture halting system. First provided is a chair member. The chair member is in a generally planar configuration. The chair member is in a horizontal plane. The chair member has a distal end. The distal end has a large arcuate section. In this manner the distal end is contacted by a lower extent of a large chair leg. The distal end has a small arcuate section. In this manner the distal end is contacted by a lower extent of a small chair leg. The chair member has a proximal end. The proximal end has a pair of laterally spaced pivot apertures. The apertures have parallel vertical axes.

A large and a small arcuate filler piece are provided. The arcuate filler pieces are removably positioned in the large and small arcuate sections of the chair member. The arcuate section has parallel recesses. The arcuate filler pieces have a planar exterior face and an arcuate interior face. The arcuate filler pieces have parallel projections. The projections are positionable within the recesses. In this manner the arcuate filler piece are optionally used.

Provided next is a wall member. The wall member includes two similarly shaped wall components. Each wall component has a vertical section. The vertical section is positionable in contact with the adjacent wall. Each wall component has a horizontal component. The horizontal component extends away from the adjacent wall. The horizontal component faces the chair member. Each wall component has a pivot aperture. The aperture has a vertical axis. Each wall component has an attachment aperture. The aperture has a horizontal axis. The wall member includes a screw. The screw extends through each attachment aperture of the wall component. In this manner the wall member is secured to the adjacent wall.

Further provided is an extension assembly. The extension assembly is in a horizontal plane. The extension assembly includes two similarly shaped legs. Each leg has an exterior piece. Each exterior piece has a semi-circular distal end and a linear proximal end. Each exterior piece has a pivot aperture. The pivot aperture of each exterior piece overlies the pivot aperture of one of the chair members. Each exterior piece has a distal pivot pin. The distal pivot pins pivotally couple the legs to the chair member. Each leg has an interior piece. Each interior piece has a semi-circular proximal end and a linear distal end. Each interior piece has a pivot aperture. The pivot aperture of the interior piece overlies the pivot aperture of the wall components of the wall member. Each interior piece has a proximal pivot pin. The proximal pivot pins pivotally couple the legs to the wall components of the wall member.

The extension assembly includes a plurality of extension pieces of varying length in each leg. The extension pieces are fabricated of a transparent plexiglass in a generally rectangular configuration. The extension pieces have linear edges and arcuate edges. The extension pieces extend between an interior and an exterior piece. The interior and exterior extension pieces have a linear coupling edge with cylindrical projections and complementary cylindrical recesses. The interior and exterior extension pieces are adapted to be utilized to selectively increase and decrease the distance between the chair member and the wall member.

Provided last are a termination pieces and cylindrical recesses. The termination pieces have cylindrical projections. The projections are positionable in the cylindrical recesses of the chair member. In this manner the width of an extension piece can be increased when utilized as a spacer component.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved furniture halting system which has all of the advantages of the prior art wall protection systems of known designs and configurations and none of the disadvantages.

It is another object of the present invention to provide a new and improved furniture halting system which may be easily and efficiently manufactured and marketed.

It is further object of the present invention to provide a new and improved furniture halting system which is of durable and reliable constructions.

An even further object of the present invention is to provide a new and improved furniture halting system which is susceptible of a low cost of manufacture with regard to both materials and labor, and which accordingly is then susceptible of low prices of sale to the consuming public, thereby making such furniture halting system economically available to the buying public.

Even still another object of the present invention is to provide a furniture halting system for positioning a chair at a location spaced from an adjacent wall to preclude contacting and damaging the adjacent wall, the positioning being accomplished in a safe, convenient and economical manner.

Lastly, it is an object of the present invention to provide a new and improved furniture halting system. A chair member is in a generally planar configuration in a horizontal plane. The chair member has a distal end with a receptive section for being contacted by a lower extent of a furniture such as but not limited to a chair leg. A wall member has a vertical section positionable in contact with an adjacent structure such as but not limited to a wall. Each wall member has a horizontal section extending away from the adjacent wall and facing the chair member. An extension assembly has a distal end coupled to the chair member. The extension assembly has a proximal end coupled to the wall member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 12, 13, 14 and 15 are plan views of mechanisms for removably coupling components of the system.

FIGS. 22, 23, 24 and 25 are side elevational views illustrating various techniques for positioning a chair with respect to a wall with the system of the present invention there between.

The same reference numerals refer to the same parts throughout the various Figures.

DESCRIPTION OF THE PREFERRED EMBODIMENT

Figure 1:
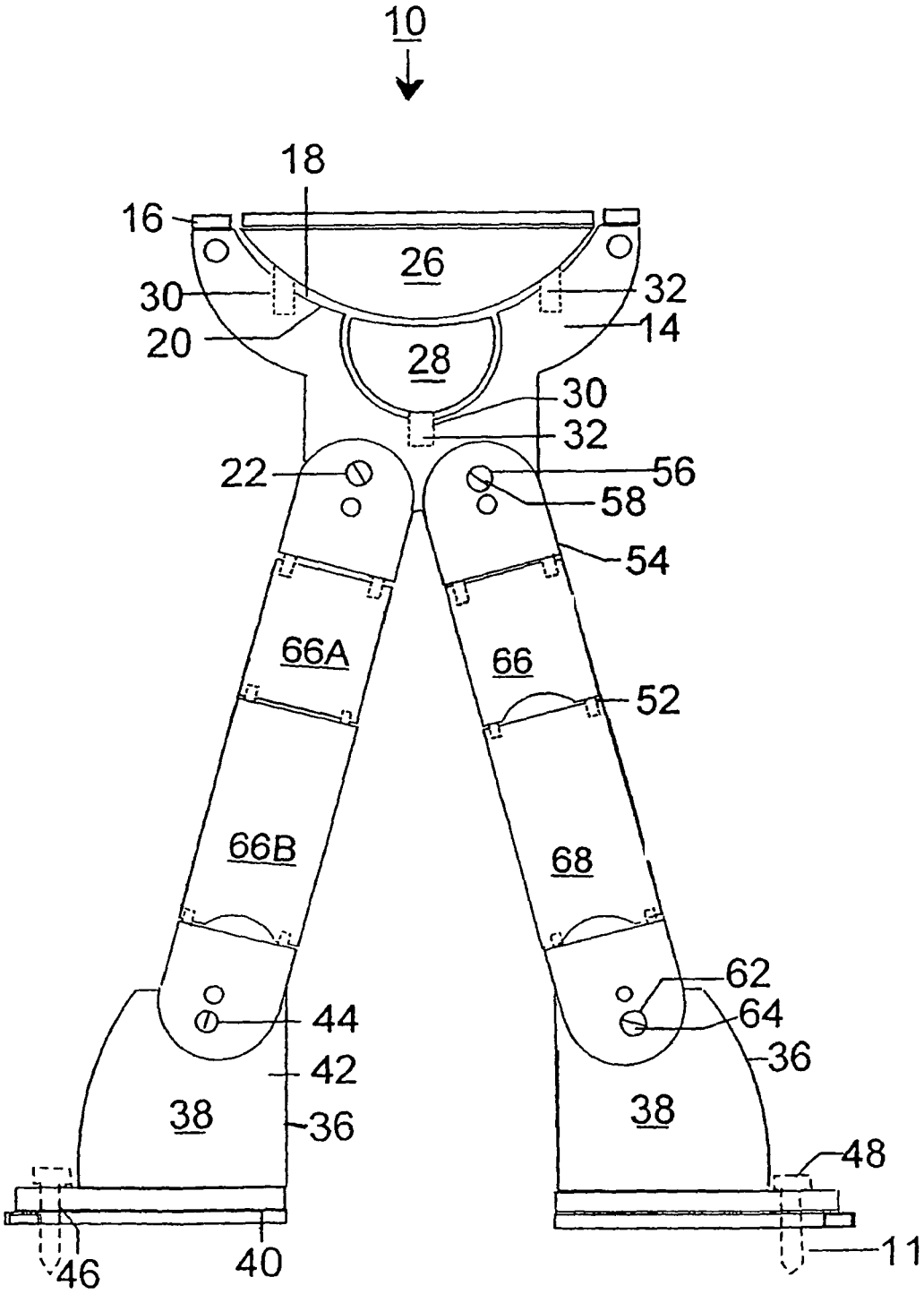
FIG. 1 is a plan view of a furniture halting system constructed in accordance with the principles of the present invention with the legs straight and parallel.
Figure 2:
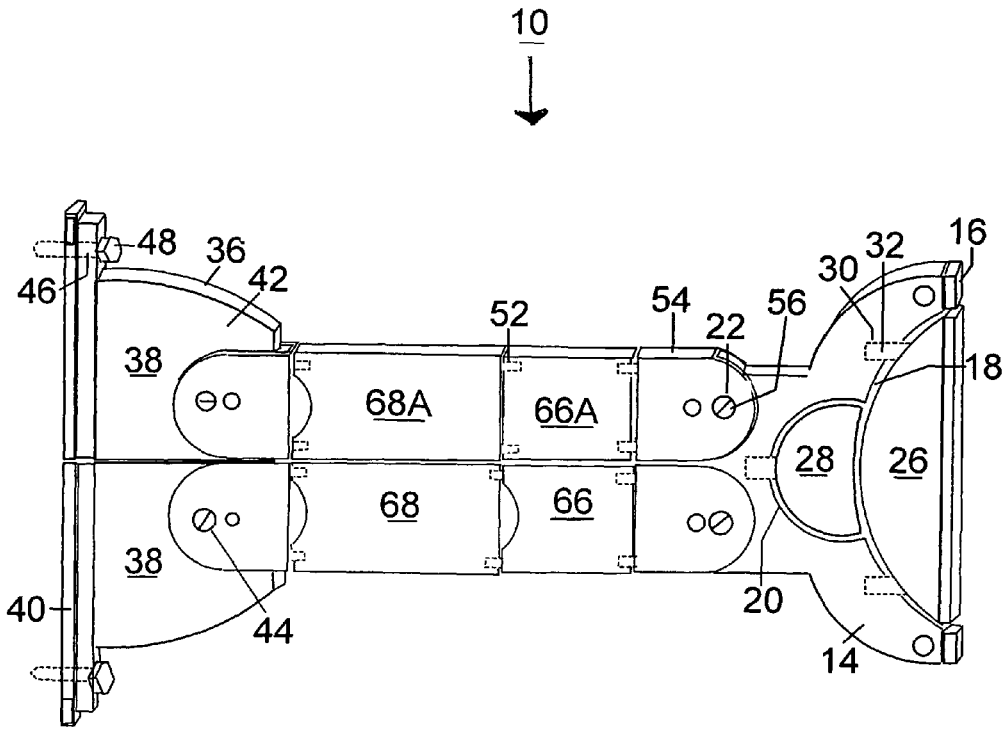
FIG. 2 is a plan view of the furniture halting system shown in FIG. 1 but with the legs spaced at an angle.

With reference now to the drawings, and in particular to FIG. 1 thereof, the preferred embodiment of the new and improved furniture halting system embodying the principles and concepts of the present invention and generally designated by the reference numeral 10 will be described.

The present invention, the furniture halting system 10 is comprised of a plurality of components. Such components in their broadest context include a chair member, a wall member and an extension assembly. Such components are individually configured and correlated with respect to each other so as to attain the desired objective.

First provided is a chair member 14. The chair member is in a generally planar configuration. The chair member is in a horizontal plane. The chair member has a distal end 16. The distal end has a large receptive arcuate section 18. In this manner the distal end is contacted by a lower extent of a furniture such as but not limited to a large chair leg. The distal end has a small receptive arcuate section 20. In this manner the distal end is contacted by a lower extent of a small chair leg. The chair member has a proximal end. The proximal end has a pair of laterally spaced pivot apertures 22. The apertures have parallel vertical axes.

A large and a small arcuate filler piece 26, 28 are provided. The arcuate filler pieces are removably positioned in the large and small arcuate sections of the chair member. The arcuate section has parallel recesses 30. The arcuate filler pieces have a planar exterior face and an arcuate interior face. The arcuate filler pieces have parallel projections 32. The projections are positionable within the recesses. In this manner the arcuate filler piece are optionally used.

Provided next is a wall member 36. The wall member includes two similarly shaped wall components 38. Each wall component has a vertical section 40. The vertical section is positionable in contact with the adjacent structure such as but not limited to a wall. Each wall component has a horizontal component 42. The horizontal component extends away from the adjacent wall. The horizontal component faces the chair member. Each wall component has a pivot aperture 44. The aperture has a vertical axis. Each wall component has an attachment aperture 46. The aperture has a horizontal axis. The wall member includes a screw 48. The screw extends through each attachment aperture of the wall component. In this manner the wall member is secured to the adjacent wall.

Further provided is an extension assembly 52. The extension assembly is in a horizontal plane. The extension assembly includes two similarly shaped legs. Each leg has an exterior piece 54. Each exterior piece has a semi-circular distal end and a linear proximal end. Each exterior piece has a pivot aperture 56. The pivot aperture of each exterior piece overlies the pivot aperture of one of the chair members. Each exterior piece has a distal pivot pin 58. The distal pivot pins pivotally couple the legs to the chair member. Each leg has an interior piece 60. Each interior piece has a semi-circular proximal end and a linear distal end. Each interior piece has a pivot aperture 62. The pivot aperture of the interior piece overlies the pivot aperture of the wall components of the wall member. Each interior piece has a proximal pivot pin 64. The proximal pivot pins pivotally couple the legs to the wall components of the wall member.

The extension assembly includes a plurality of extension pieces 66, 66A, 68, 68B of varying length in each leg. The extension piece are in a generally rectangular configuration. The extension pieces have linear edges and arcuate edges. The extension pieces extend between an interior and an exterior piece. The interior and exterior extension pieces have a linear coupling edge with cylindrical projections 70 and complementary cylindrical recesses 72. The interior and exterior extension pieces are adapted to be utilized to selectively increase and decrease the distance between the chair member and the wall member.

Provided last are termination pieces 76. The termination pieces have cylindrical projections and cylindrical recesses. The projections are positionable in the cylindrical recesses of the chair member. In this manner the width of an extension piece can be increased when utilized as a spacer component. A transparent plexiglass is the preferred material for the extension pieces as well as for the termination pieces.

Figure 3:
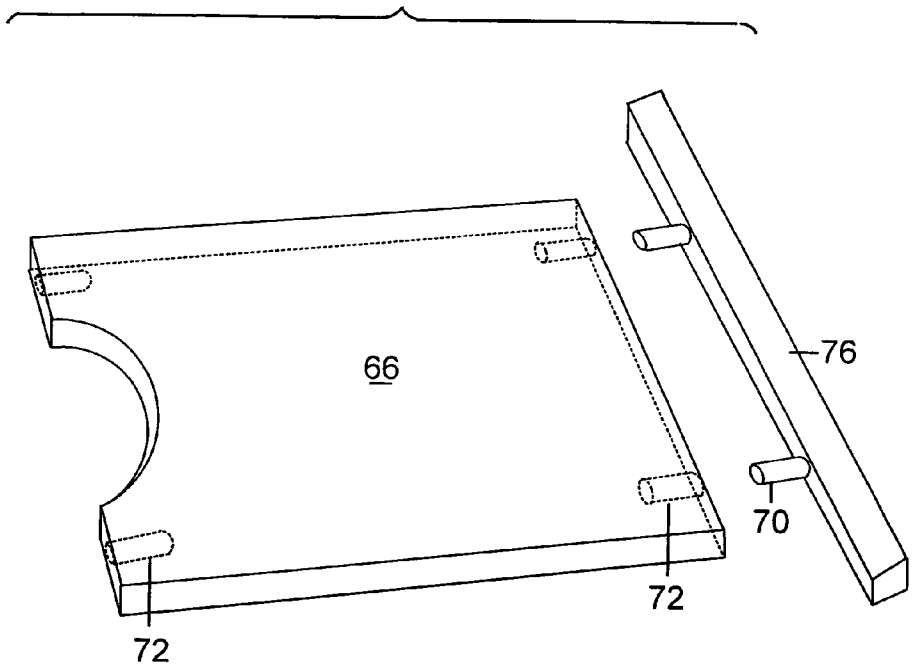
FIGS. 3 and 4 are perspective illustrations of components of the system of the prior Figures.
Figure 4:
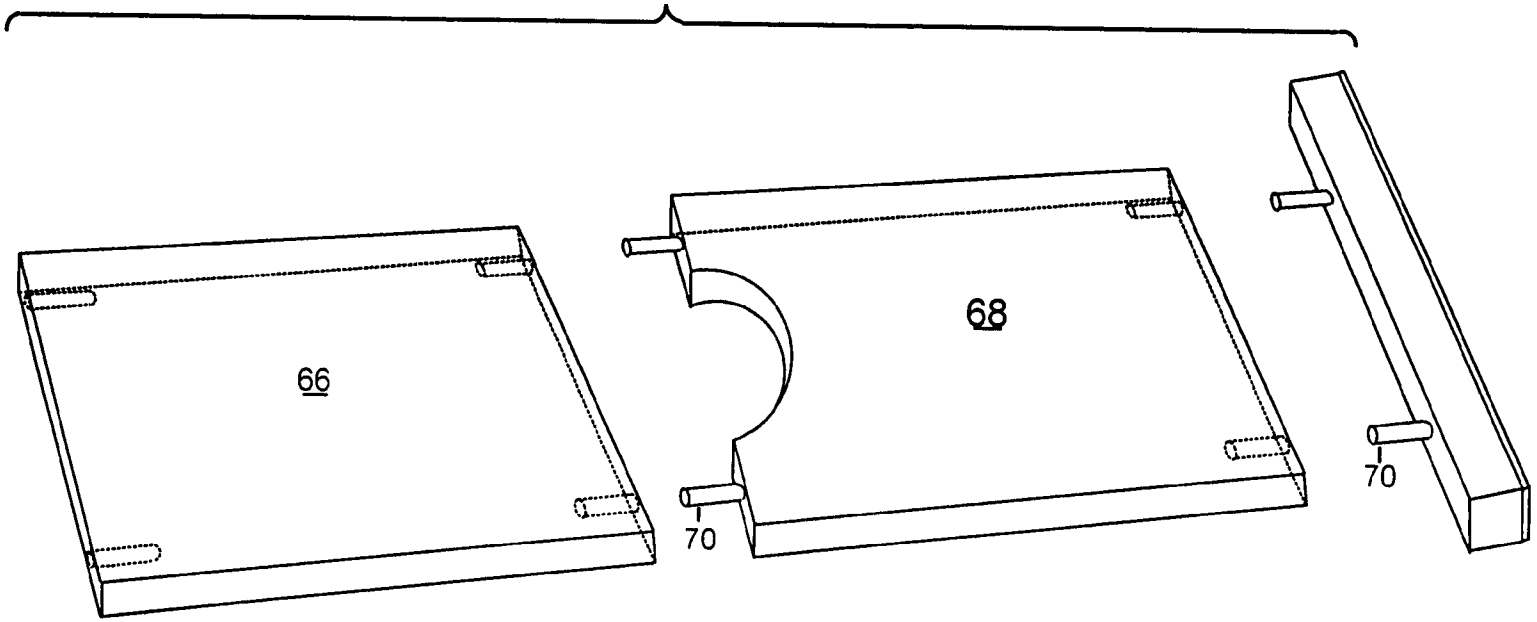
Figure 5:
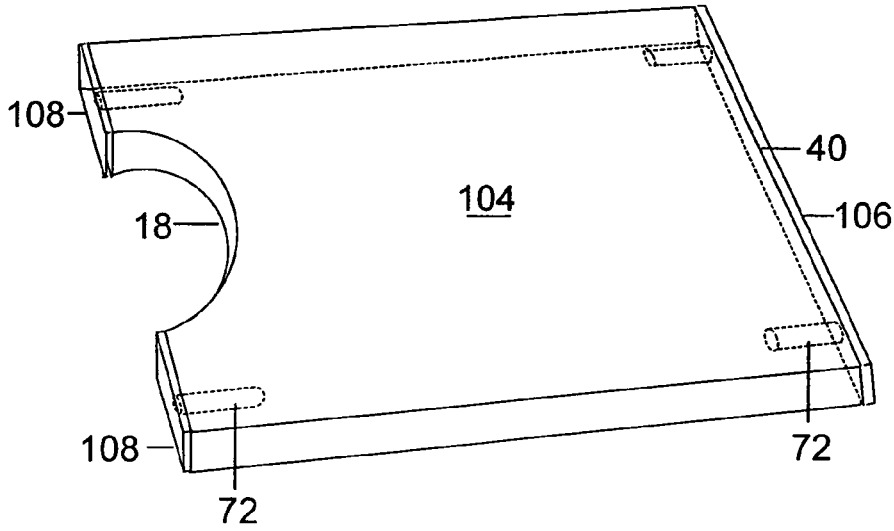
FIGS. 5, 6 and 7 are perspective illustrations of components of the system similar to FIGS. 3 and 4 but illustrating an alternate embodiment of the system.
Figure 6:
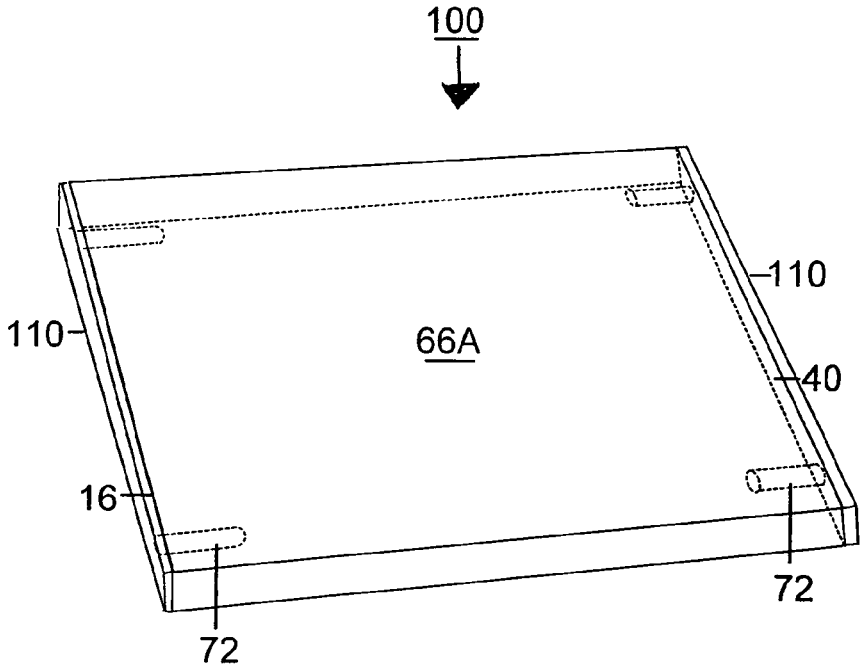
Figure 7:
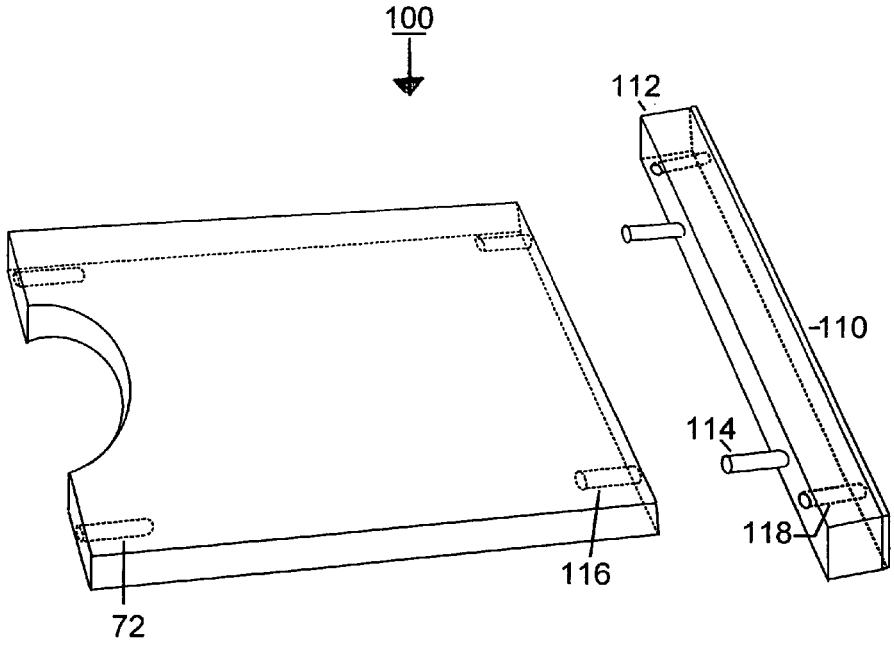
Figure 8:
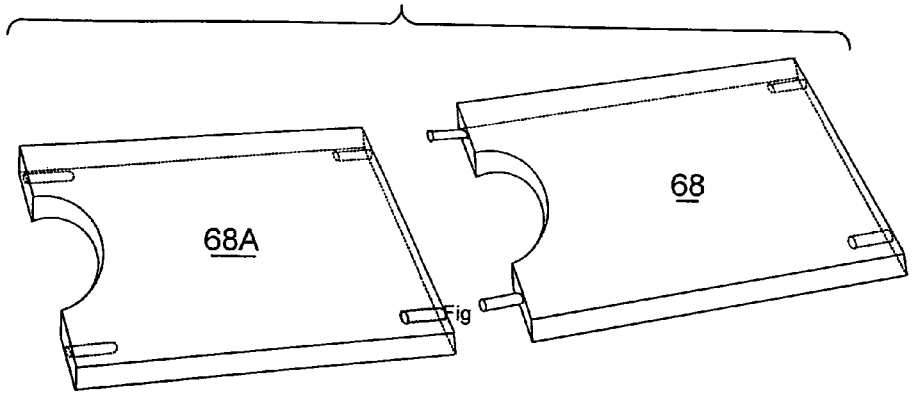
FIGS. 8, 9, 10 and 11 are perspective illustrations of components of the system of the prior Figures, the components being coupled together.
Figure 9:
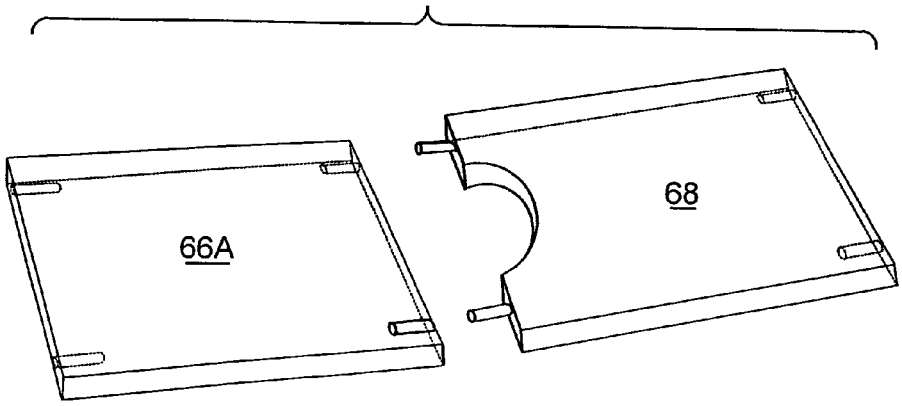
Figure 10:
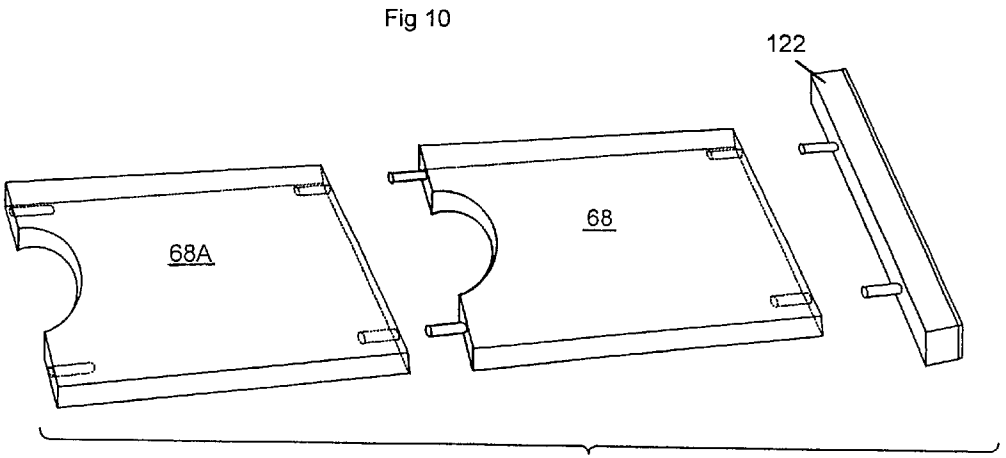
Figure 11:
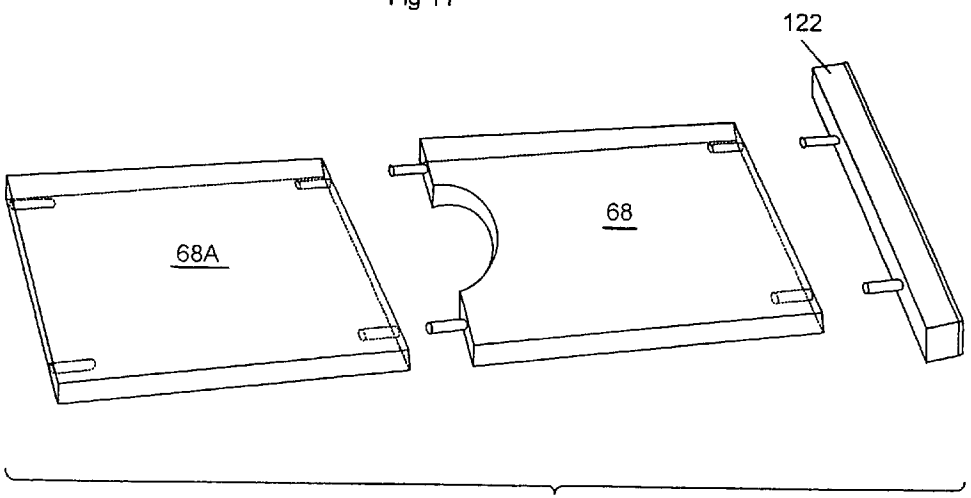

FIGS. 5, 6 and 7 are perspective illustrations of components of the system similar to FIGS. 3 and 4 but illustrating an alternate embodiment 100 of the system. In FIG. 5, component 104 includes an adhesive layer 106 on the proximal edge of the component similar to element 66. The adhesive layer is adapted to couple the component to a wall safely and securely at an appropriate location. FIG. 5 also includes laterally spaced resilient layers 108 on the distal edge of the component to preclude damage to a chair leg as would otherwise occur through contact between the chair leg and the component. FIG. 6 shows a component similar to component 66A but including an adhesive layer 110 on the proximal edge, similar to FIG. 5, and a single resilient layer on the distal edge. FIG. 7 features a component 66 adapter to removably receive an intermediate element 112. The element 112 is wider than the component and includes projections 114 positionable in the recesses 116 of the component. The component includes an adhesive layer on its proximal edge. The component also includes holes 118 laterally spaced from the component for screwing the element to the wall.

FIGS. 8, 9, 10 and 11 are perspective illustrations of components of the system of the prior Figures, the components being coupled together and interlinked in various manners. Such manners include two long components 68 and 68A in FIG. 8, a short and a long component 68, 66A in FIG. 9, two long components 68, 68A and an intermediate element 122 in FIG. 10, and lastly, a short and a long component 68, 66A and an intermediate element 112 in FIG. 11.

Figure 14:
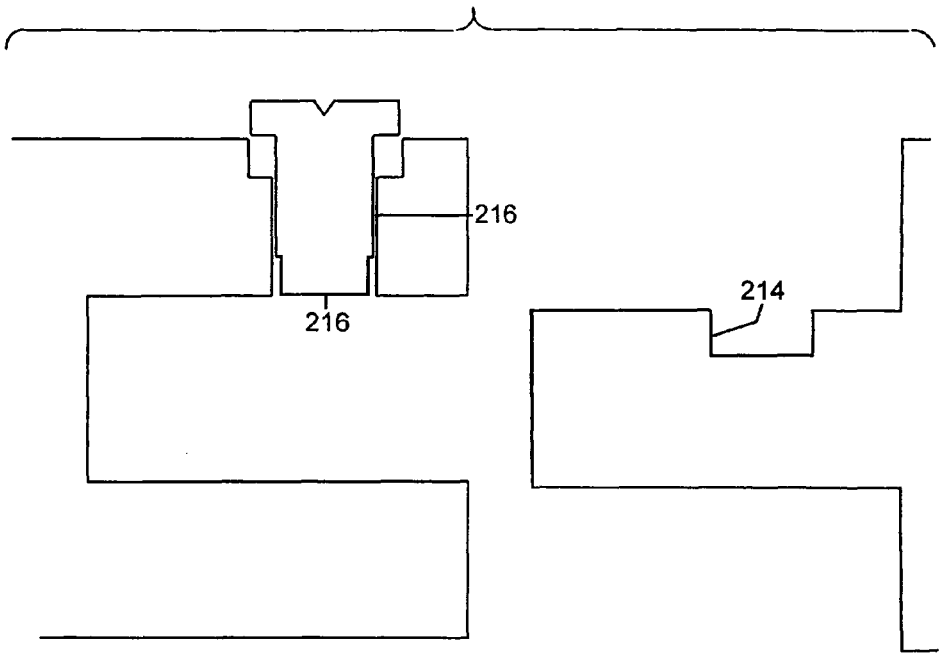
Figure 15:
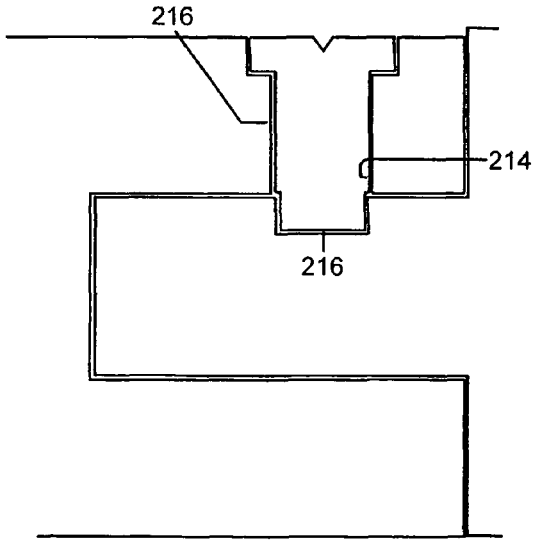
Figure 16:
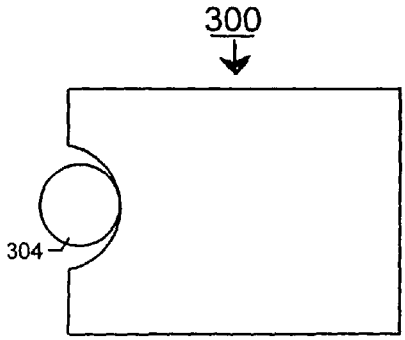
FIGS. 16, 17, 18 and 19 are plan views of various chair legs in contact with the system of the present invention.
Figure 17:
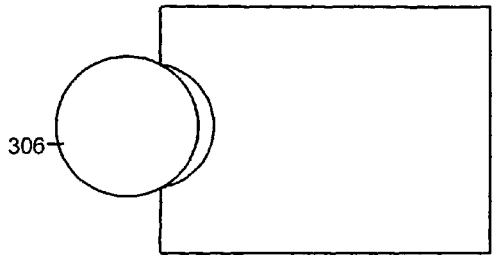
Figure 18:
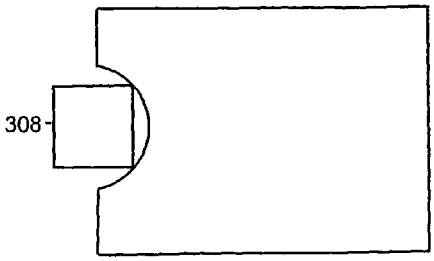
Figure 19:
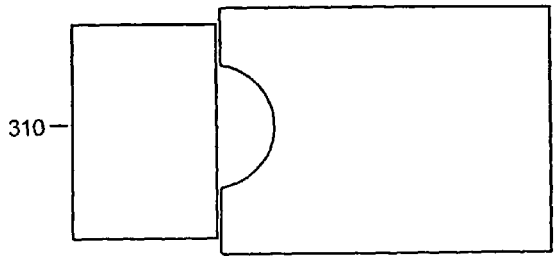

FIGS. 12, 13, 14 and 15 are plan views of mechanisms 200 for removably coupling components of the system, as for example, the removable coupling of a projection 204 of an intermediate member to a recess 206 of a component. In FIGS. 12 and 13, annular recesses 208, 210 are formed in the projection and the recess. A resilient O-ring 212 is positioned within the recess 210 of the recess whereby the projection may be inserted into, and removed from, the recess by a user applying an axial force. FIGS. 14 and 15 feature a depression 214 in the projection and a threaded aperture 216 with a bolt adjacent to the recess 218. Rotation of the bolt by a user will secure and then unsecure the projection with respect to the recesses.

Figure 20:
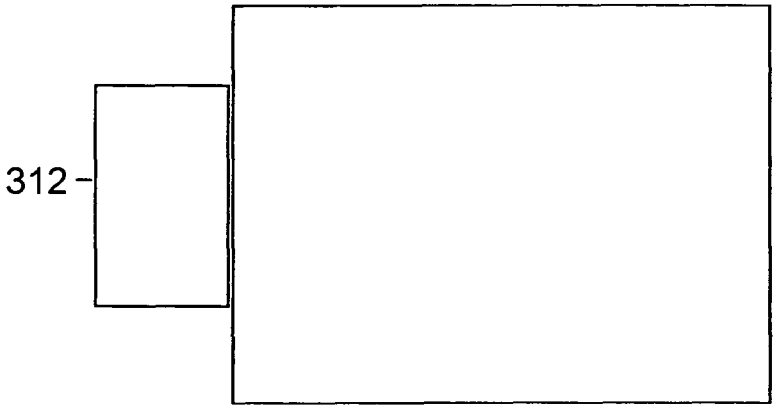
FIGS. 20 and 21 are plan views of the present invention contacting chair legs of various shapes.
Figure 21:
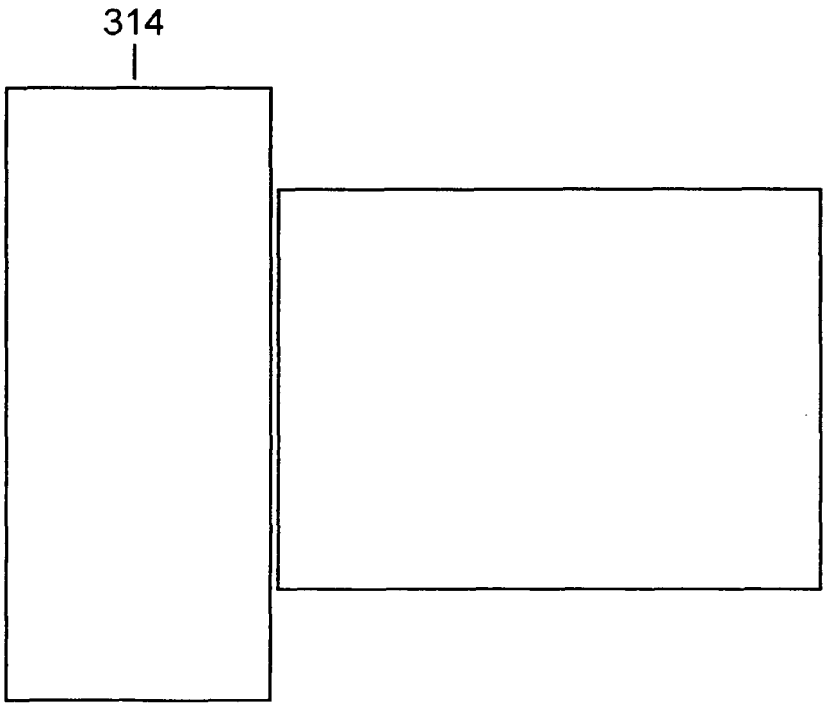

FIGS. 16, 17, 18 and 19 are an alternate embodiment 300 featuring plan views of various chair legs 304, 306, 308, 310 in contact with a long component 68, 68A of the system of the present invention. FIGS. 20 and 21 are plan views of short components 66, 66A of the present invention contacting chair legs 312, 314 of various shapes.

Figure 22:
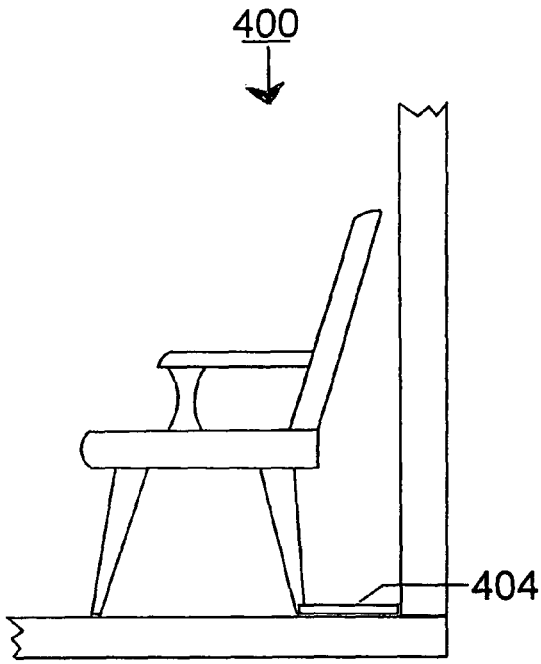
Figure 23:
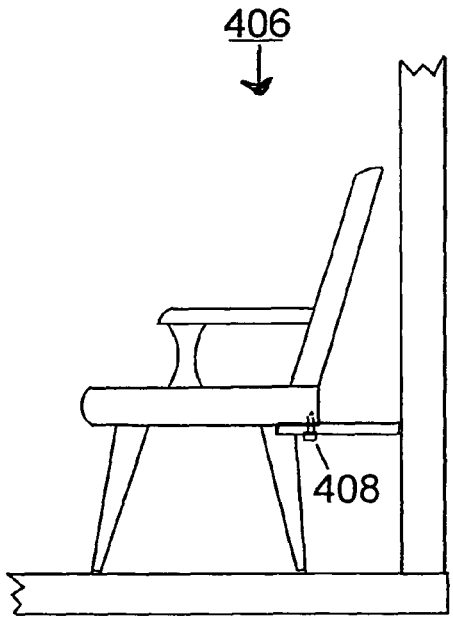
Figure 24:
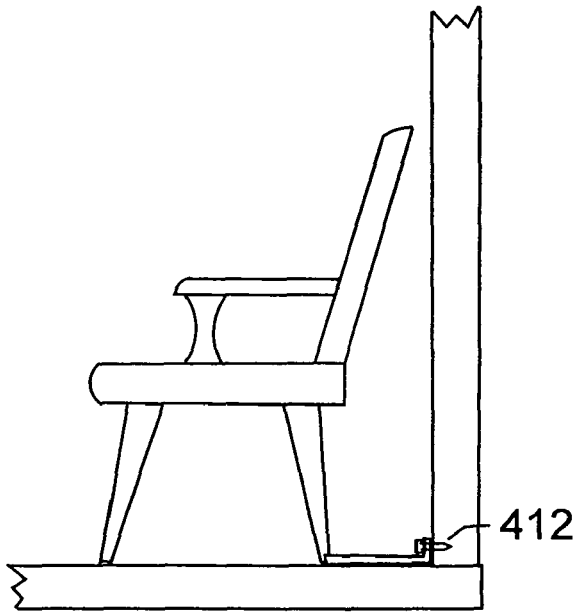
Figure 25:
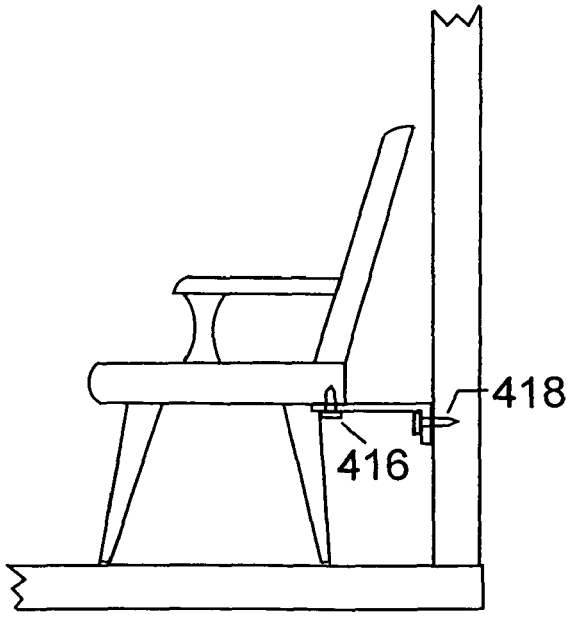

FIGS. 22, 23, 24, 25 and 26 are side elevational views illustrating various embodiments 400 featuring various systems for positioning a chair with respect to a wall with the system of the present invention there between. The system 404 of FIG. 22 is unsecured to the wall and the chair. The system 406 of FIG. 23 features a screw 408 coupling the distal end of the system to a chair at an intermediate elevation. The system 410 of FIG. 24 features a screw 412 coupling the proximal end of the system to a wall at a lower elevation. The system 414 of FIG. 25 features a screw 416 coupling the distal end of the system to a chair at an intermediate elevation and a supplemental screw 418 coupling the toe proximal end of the system to the wall at an intermediate elevation.

These systems provide the following options for use:

a. only the chair member secured fixedly only to the furniture and other members not fixed;

b. only the wall member secured fixedly to the structures, not to an upper part of the wall as it is preferably secured to the base board, and other members are not fixed;

c. the chair member and the wall member secured fixedly to the furniture and structures respectively; and d. one or more members places on a structure such as a floor, removably between the furniture and the other structure such as the wall.

Figure 26:
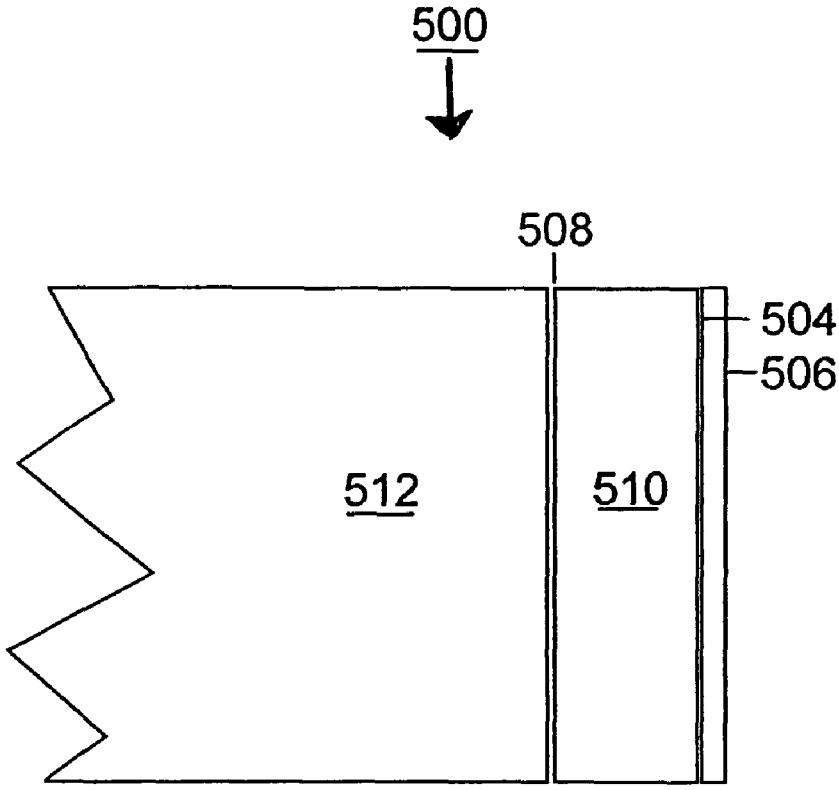
FIG. 26 is a plan view of yet another alternate embodiment of the invention.

The next alternate embodiment 500 is illustrated in FIG. 26 and features a first adhesive layer 504 between the wall 506 and an intermediate member 508 and a second adhesive layer 508 between the intermediate member and the chair.

Figure 27:
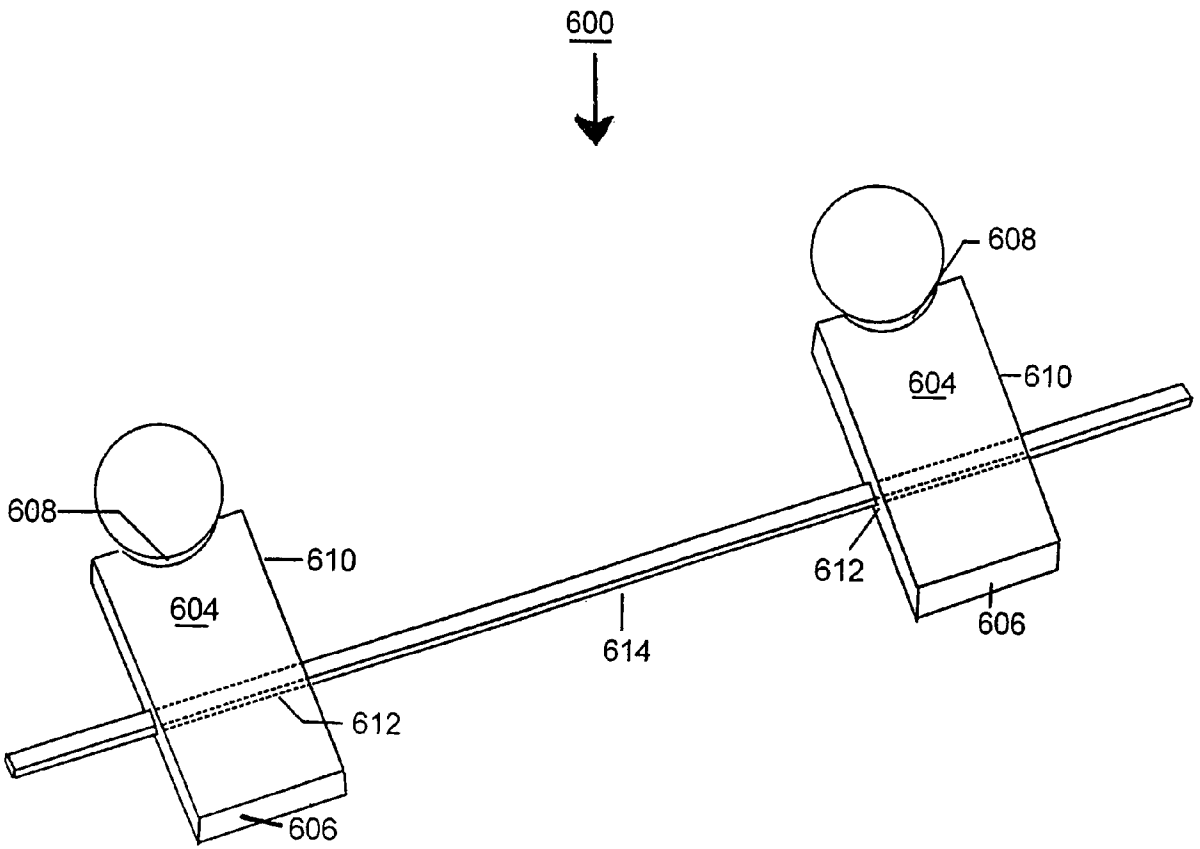
FIG. 27 is a perspective illustration of the final embodiment of the invention.
Figure 28:
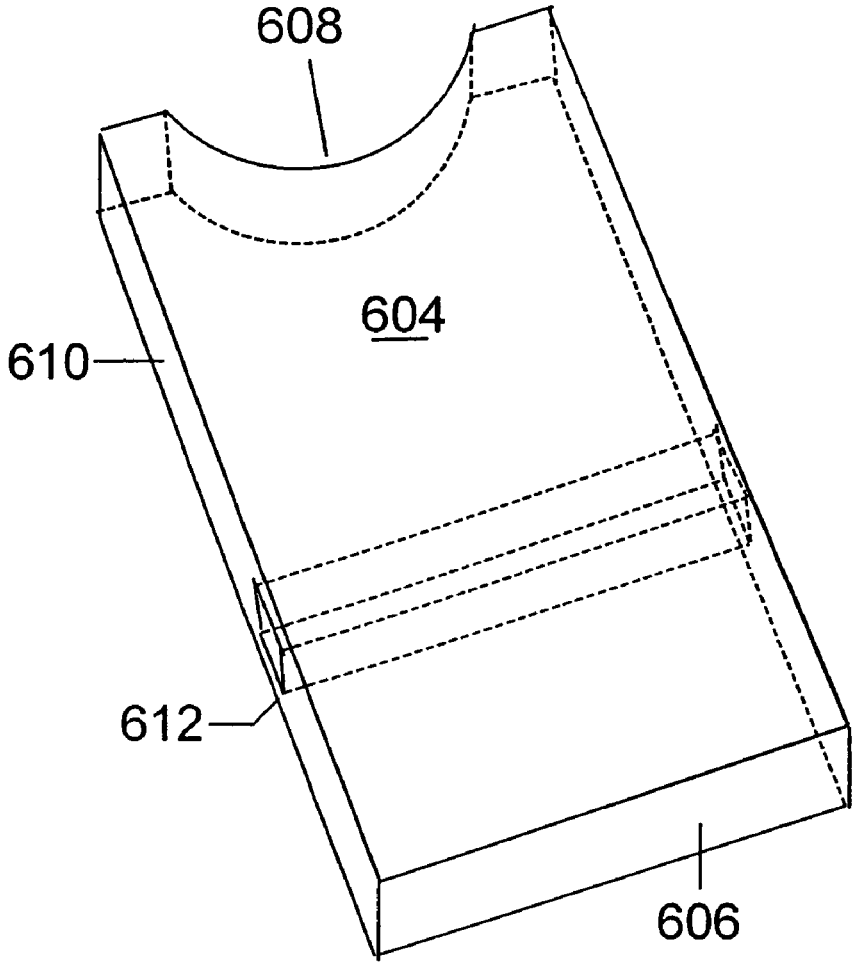
FIG. 28 is an enlarged perspective illustration of one of the components of FIG. 27.

FIGS. 27 and 28 illustrate the final alternate embodiment of the invention. The system 600 features two similarly shaped components 604, each generally rectangular in shape. Each component is formed with a front edge 606 positionable against a wall and with a rear edge 608 positionable against a leg of a chair and with parallel side edges 610, an aperture 612 extending through each component from side edge to side edge, the system further including a rod 614 positioned through the apertures to selectively position the components at a preferred distance from each other.

Different interlinking unit members are chosen for a variety of reasons. The shape of the object which is butting against the unit determines the shape of the unit or units. The function, such as whether or not the unit member needs to be secured to other structures, determines the choice of interlinking unit members. The distance between the furniture determines the number of unit members needed. Other unit members are chosen with means to swivel to be placed in an angular position and/or for additional support.

One or more interlinking unit members are placed horizontally on the floor in between the lowest region of a piece of furniture and an immobile structure, such as, but not limited to, a wall or baseboard. The front end of the device is placed butting against the furniture and the opposite end butting against the wall.

In an alternate embodiment, one or more interlocking unit members of the device are placed horizontally in between the lower interlocking region of a piece of furniture and an immobile structure, such as, but not limited to, a wall or baseboard. In this embodiment, the front end of the device is placed against the furniture and the opposite end butts against and is secured to the wall.

In another embodiment, again, one or more interlocking unit members of the device are placed horizontally in between the lower region of a piece of furniture and an immobile structure, such as, but not limited to, a wall or baseboard. In this embodiment, the front end of the device is placed butting against and is secure to the furniture and the opposite end butts against the wall.

In yet another alternate embodiment, one or more interlocking unit members of the device are placed horizontally in between the lower region of a piece of furniture and an immobile structure, such as, but not limited to, a wall or baseboard. The front end of the device is placed butting against and is secured to the furniture and the opposite end butts against and is secured to the wall.

One member or more of the extension piece alone, placed between a furniture and a wall prevents the unwanted movement of the furniture and functions as a furniture halting system. Additional members are added as and when it is necessary to modify the system to adapt to different conditions and specific requirements, and to confirm various factors such as different shapes of furniture, location of the furniture and the desired distance between the furniture and the structure, the wall.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A furniture halting system comprising:

a chair member having a generally planar configuration in a horizontal plane, the chair member having a distal end with a receptive section for being contacted by a lower extent of a furniture such as but not limited to a chair leg;

a wall member having a vertical section positionable in contact with an adjacent structure such as but not limited to a wall, each wall member having a horizontal section extending away from the adjacent wall and facing the chair member; and an extension assembly having a distal end coupled to the chair member and a proximal end coupled to the wall member wherein the extension assembly is in a horizontal plane and composed of similarly shaped legs, each leg having an exterior piece with a semi-circular distal end and a linear proximal end, each exterior piece having a pivot aperture overlying the pivot aperture of the chair member and with a pivot pin pivotally coupling the legs to the chair member, each leg having an interior piece with a semi-circular proximal end and a linear distal end, each interior piece having a pivot aperture overlying the pivot aperture of the wall components of the wall member with a pivot pin pivotally coupling the leg to the wall components of the wall member.

2. The system as set forth in claim 1 and further including a plurality of extension pieces of varying length in each leg, the extension pieces of each leg being in a generally rectangular configuration with all linear edges or three linear edges and an arcuate edge, the extension pieces extending between an interior and an exterior piece, the interior, exterior and extension piece having a linear coupling edge with cylindrical projections and complementary cylindrical recesses adapted to be utilized to selectively increase and decrease the distance between the chair member and the wall member, and also one or more members of those extension pieces between the furniture and the wall functioning as a spacer and halting furniture movement, functioning as a furniture halting system.

3. The system as set forth in claim 2 and further including:

a termination piece with projections positionable in recesses of an extension piece for increasing the width of an extension piece when utilized as a spacer component.

4. A furniture halting system comprising:

a chair member having a generally planar configuration in a horizontal plane, the chair member having a distal end with a receptive section for being contacted by a lower extent of a furniture such as but not limited to a chair leg;

a wall member having a vertical section positionable in contact with an adjacent structure such as but not limited to a wall, each wall member having a horizontal section extending away from the adjacent wall and facing the chair member; and two similarly configured extension assemblies having a distal end coupled to the chair member and a proximal end coupled to the wall member wherein the extension assemblies are each generally rectangular in shape with a front edge positionable against a wall and with a rear edge positionable against a leg of a chair and with parallel side edges, an aperture extending through each component from side edge to side edge, the system further including a rod positioned through the apertures to selectively position the components at a preferred distance from each other.

5. A furniture halting system for positioning a furniture such as but not limited to a chair at a location spaced from an adjacent structure to preclude contacting and damaging the adjacent structure such as but not limited to a wall, the positioning being accomplished in a safe, convenient and economical manner, the system comprising, in combination:

a chair member having a generally planar configuration in a horizontal plane, the chair, member having a distal end with a large arcuate section for being contacted by a lower extent of a large chair leg, the distal end having a small arcuate section for being contacted by a lower extent of a small chair leg, the chair member having a proximal end with a pair of laterally spaced pivot apertures with parallel vertical axes;

a large and a small arcuate filler piece, removably positioned in the large and small arcuate sections of the chair member, the arcuate section having parallel recesses, the arcuate filler pieces having a planar exterior face and an arcuate interior face with projections positionable within the recesses for the optional use of the arcuate filler piece;

a wall member composed of two similarly shaped wall components, each wall component having a vertical section positionable in contact with the adjacent wall, each wall component having a horizontal component extending away from the adjacent wall and facing the chair member, each wall component having a pivot aperture with a vertical axis, each wall component having an attachment aperture with a horizontal axis, a screw extending through each attachment aperture of the structure such as but not limited to a wall component for securement to the adjacent wall;

an extension assembly in a horizontal plane and composed of two similarly shaped legs, each leg having an exterior piece with a semi-circular distal end and a linear proximal end, each exterior piece having a pivot aperture overlying the pivot aperture of the chair member and with a pivot pin pivotally coupling the legs to the chair member, each leg having an interior piece with a semi-circular proximal end and a linear distal end, each interior piece having a pivot aperture overlying the pivot aperture of the wall components of the wall member with a pivot pin pivotally coupling the legs to the wall components of the wall member, a plurality of extension pieces of varying length in each leg, the extension pieces of each leg being fabricated of a transparent plexiglass in a generally rectangular configuration with three linear edges and an arcuate edge, the extension pieces extending between an interior and an exterior piece, the interior, exterior and extension piece having a linear coupling edge with cylindrical projections and complementary cylindrical recesses adapted to be utilized to selectively increase and decrease the distance between the chair member and the wall member; and a termination piece with cylindrical projections positionable in cylindrical recesses of an extension piece for increasing the width of an extension piece when utilized as a spacer component, the individual members with different functions of this system in part or as a whole being connected to one another either removably and fixedly.

* * * * *